US005297535A

United States Patent [19]

Chi

[11] Patent Number: 5,297,535

[45] Date of Patent: Mar. 29, 1994

[54] IGNITION DEVICE FOR WATER HEATERS

[76] Inventor: Chang P. Chi, P.O. Box 82-144, Taipei, Taiwan

[21] Appl. No.: 947,921

[22] Filed: Sep. 21, 1992

[51] Int. Cl.[5] ..... F24H 1/00

[52] U.S. Cl. ..... 126/351; 137/94; 431/46

[58] Field of Search ..... 126/351, 374; 137/94; 431/46

[56] References Cited

U.S. PATENT DOCUMENTS 4,770,161 9/1988 Charron ..... 126/351

FOREIGN PATENT DOCUMENTS 810966 4/1937 France ..... 137/94

*Primary Examiner*—Carroll B. Dority

*Attorney, Agent, or Firm*—Alfred Lei

[57] ABSTRACT

This invention relates to an ignition device for water heaters and in particular to one including a body portion, a water container including a diaphragm fixedly mounted on the bottom of the body portion and having a lift rod extending into the body portion, a valve mounted within the body portion and located above the lift rod of the water container, a linking rod attached on the top of the housing of the valve and extending upwardly through a valve gasket to connect with a gas valve, and a solenoid mounted on a top of said body portion and connected with a leak-proof gasket via a rod, whereby the gas valve will be automatically closed when the fire is blown out thereby preventing gas from leaking outside and therefore ensuring safety.

1 Claim, 5 Drawing Sheets

IGNITION DEVICE FOR WATER HEATERS

BACKGROUND OF THE INVENTION

It has been found that the prior art ignition device for water heaters on the market utilizes water pressure to open the gas valve thereby setting on fire. However, the gas valve of such ignition device will not be automatically closed when the fire is distinguished hence often causing accidents.

Therefore, it is an object of the present invention to provide an ignition device for water heaters which may obviate and mitigate the above-mentioned drawbacks.

SUMMARY OF THE INVENTION

This invention relates to an improved ignition device for water heaters.

It is the primary object of the present invention to provide an ignition device for water heaters which may prevent the gas from leaking outside.

It is another object of the present invention to provide an ignition device for water heaters which will automatically close the valve when the fire is blown out.

It is still another object of the present invention to provide an ignition device for water heaters which is safe is use.

It is still another object of the present invention to provide an ignition device for water heaters which is simple in construction.

It is a further object of the present invention to provide an ignition device for water heaters which is facile to facile to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1A:
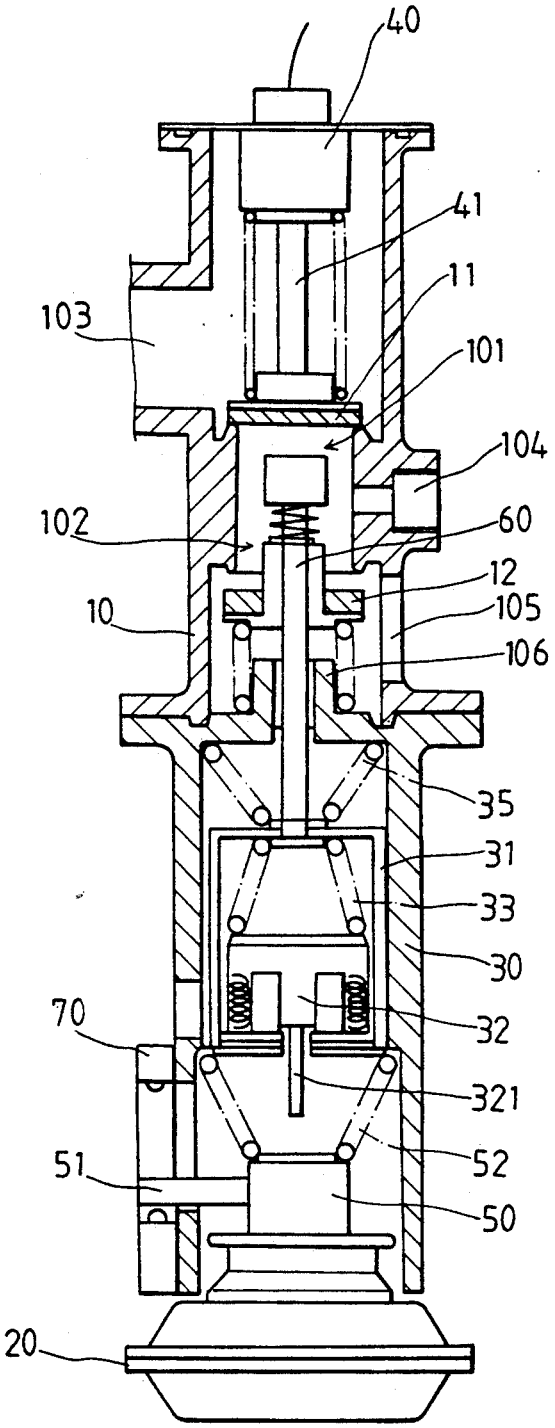
FIG. 1A is a sectional view of the present invention.

With reference to the drawings and in particular to FIG. 1A thereof, the ignition device for water heaters according to the present invention mainly comprises a body portion 10, a water container including a diaphragm, a valve 30, a solenoid 40, a lift rod 50, a linking rod 60, and a micro-switch 70. The water container including a diaphragm; is fixedly mounted on the lower end of the body portion 10 while the solenoid 40 is arranged on the top of the body portion 10. Within the body portion 10 there are a gas valve 101, a main fire valve 102 located under the gas valve 101 and a seat 106 under the main fire valve 102. Between the gas valve 101 and the solenoid 40 there is a gas inlet 103. Between the gas valve 101 and the main fire valve 102 there is a parent gas inlet 104. Further, there is a main gas inlet 105 between the main fire valve 102 and the seat 106. The water container 20 is fixedly mounted on the bottom of the body portion 10 and has a lift rod 50 extending into the body portion 10. Further, the lift rod 50 is provided with an arm 51 extending through the body portion 10 to contact a micro-switch 70. The micro-switch 70 is mounted on the lower portion of the body portion 10. In addition, the lift rod 50 is provided with a spring 52 on the top. The solenoid valve 30 is mounted within the body portion 10 and located above the lift rod 50. The valve 30 is composed of a housing 31 and an electromagnet 32. The electromagent 32 is provided at the lower end with a rod 321 extending downwardly through the housing 31 and provided at the top with a cushioning spring 33. A spring 35 is mounted on the top of the housing 31 for urging the housing 31 to go downward. The linking rod 60 is attached on the top of the housing 31 and extends upwardly through a gasket 106 and a valve seat 12 to connect with a valve 101. The valve gasket 12 is disposed between the two springs so that the valve gasket 12 may be kept between the main fire valve 102 and the seat 106. The solenoid 40 is mounted on the top of the body portion 10 and connected with a leak-proof gasket 11 via a rod 41 is activated by a thermocouple to hold rod 41 in a valve opening position.

Figure 1B:
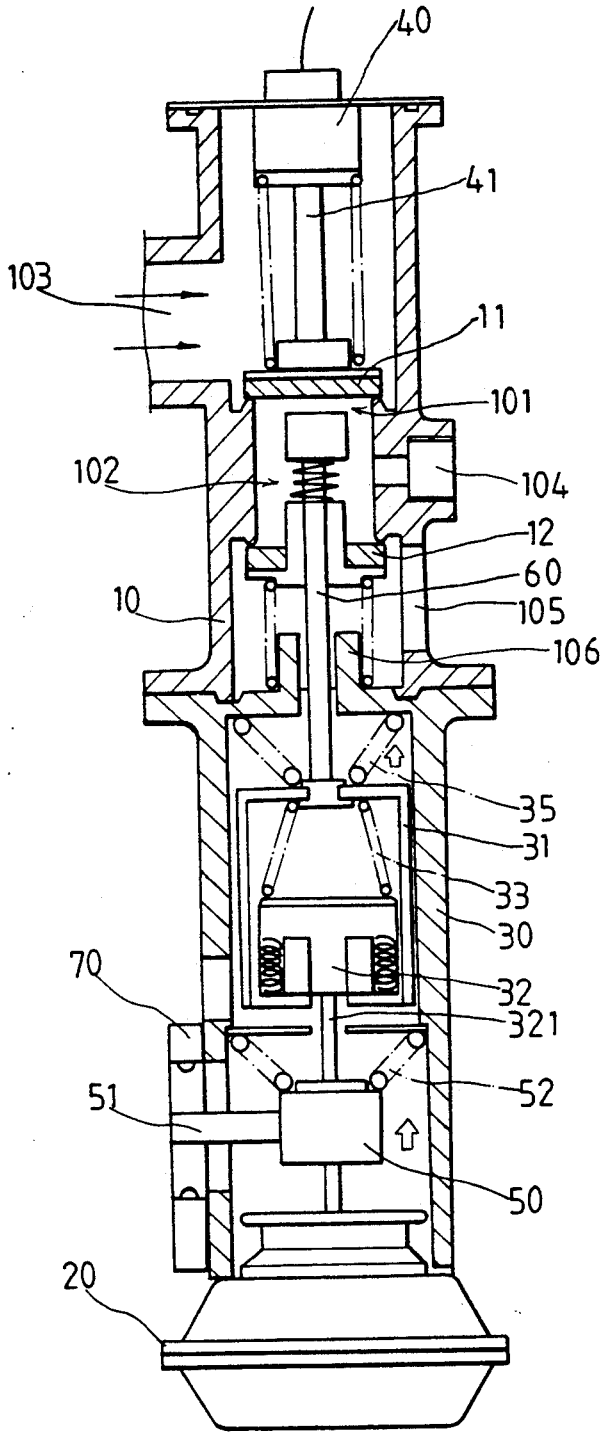
FIGS. 1B, 1C, 1D and 1E show the principle of the present invention.
Figure 1C:
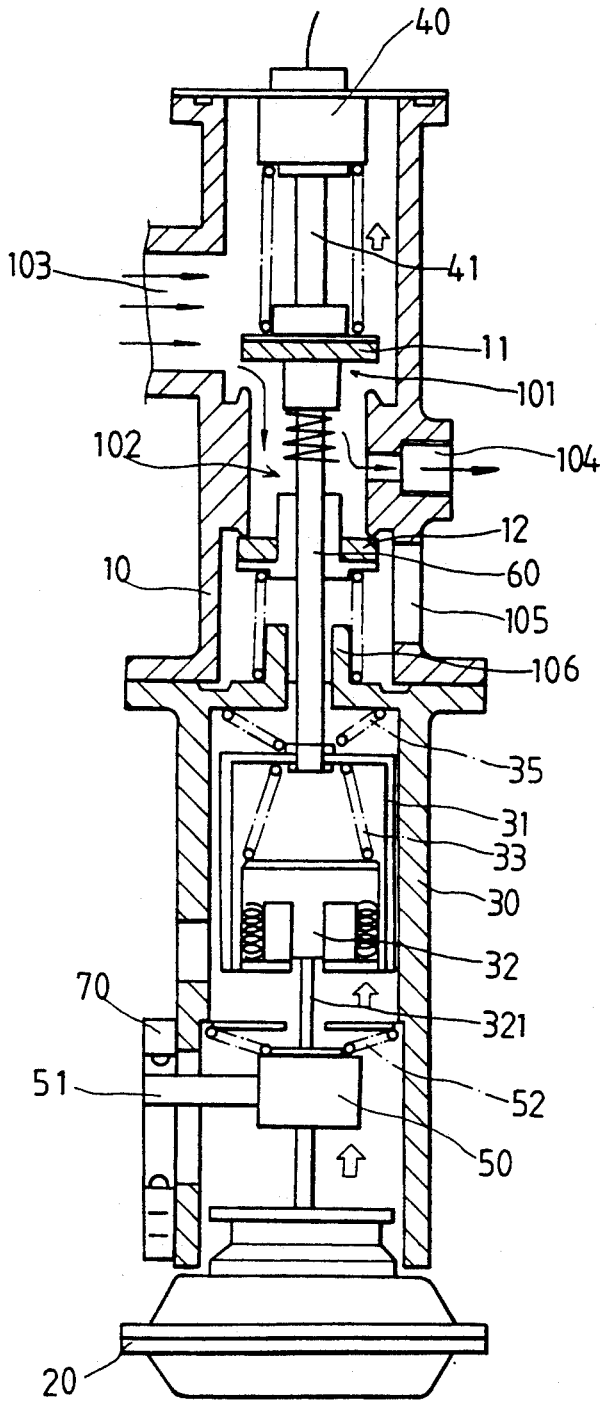
Figure 1D:
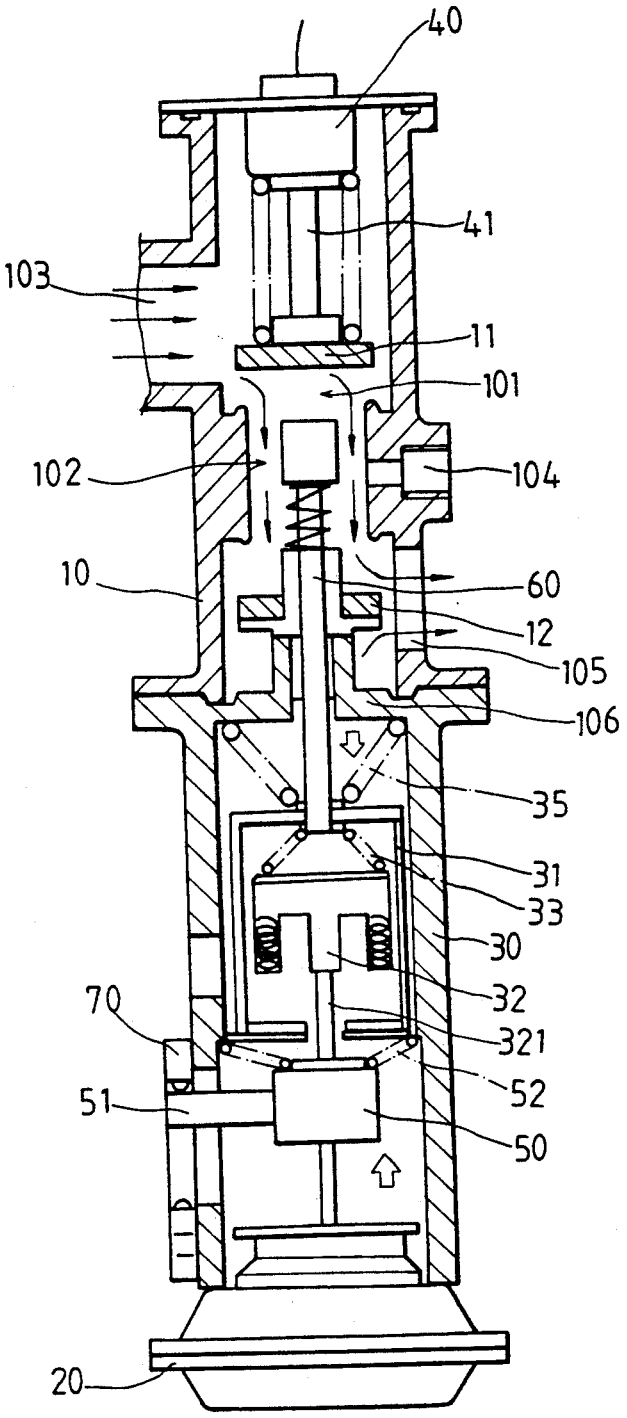
Figure 1E:
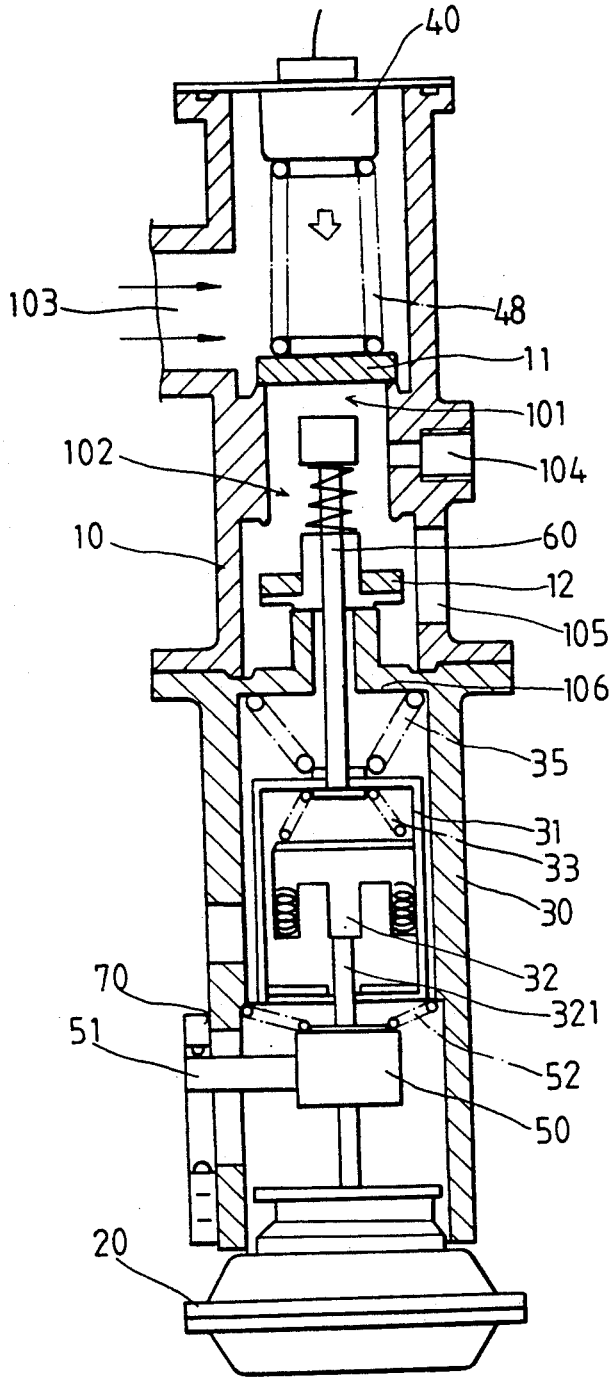

When not in use (see FIG. 1A), the valve 101 is kept closed and the micro-switch 70 is at the off-position. In case a faucet connected with the water heater equipped with the present invention is turned open, water will first flow through the water container 20 (the water container 20 is connected with the faucet); and the micro-switch 70 will be turned on by the arm 51 of the lift rod 50 thereby making the electromagnet 32 attract the housing 31. As the lift rod 50 goes upward, the lift rod 50 will push the rod 321 to go upward thus raising the housing 31. Then, the linking rod 60 is also lifted upward hence pushing the valve gasket 12 to close the main fire valve 102 (see FIG. 1B). As the lift rod 50 goes further upward, the rod 41 will be lifted to raise the leak-proof gasket 11 thus opening the valve 101. Meanwhile, the gas may flow through the inlet 103 and the valve 101 into the parent gas inlet 104 so as to ignite the parent fire (see FIG. 1C). When the parent fire is ignited, the detector (not shown) of the solenoid 40 will be first heated thus keeping the rod 41 at a retracted position and therefore, keeping the valve 101 open. Then the detector (not shown) of the electromagnet 32 is then heated to demagnetize the electromagnet 32. In the meantime, the spring 35 will force the housing 31 to return to its original position so that the linking rod 60 is lowered to open the main fire valve 102. Then, the gas may flow through the main fire valve 102 into the main fire inlet 105 to ignite the main fire (see FIG. 1D). In case the main fire and the parent fire are distinguished, the detector of the solenoid 40 will not be subjected to heat and the spring 48 will force the rod 41 to go downward thereby closing the valve 101 and therefore preventing gas from leaking outside.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An ignition device for water heaters comprising:

a body portion;

a mirco-switch mounted on a lower portion of said body portion;

a water container including a diaphragm fixedly mounted on a bottom of said body portion and having a lift rod extending into said body portion, said lift rod having a spring thereon and being formed with an arm extending through said body portion to contact said micro-switch;

a valve operating means mounted within said body portion and located above the lift rod of said water container, said valve operating means having a housing and an electromagnet which is provided with a rod extending downwardly through said housing;

a linking rod attached on a top of the housing of said valve operating means and extending upwardly through a valve gasket to connect with a leak-proof gasket; and a solenoid mounted on a top of said body portion and connected with said leak-proof gasket via a rod.

* * * * *